US005188682A

United States Patent [19]

Lochner et al.

[11] Patent Number: 5,188,682

[45] Date of Patent: Feb. 23, 1993

[54] PROPELLENT MEDIUM FOR HYBRID WEAPON

[75] Inventors: Gunther Lochner, Altdorf; Wolfgang Schwarz, Nuremberg, both of Fed. Rep. of Germany

[73] Assignee: Diehl GmbH & Co., Nürnberg, Fed. Rep. of Germany

[21] Appl. No.: 409,503

[22] Filed: Aug. 14, 1989

[30] Foreign Application Priority Data

Sep. 10, 1988 [DE] Fed. Rep. of Germany ..... 3830902

[51] Int. Cl.[5] ..... C06B 47/00; F41F 1/00

[52] U.S. Cl. ..... 149/1; 149/88; 149/89; 89/8

[58] Field of Search ..... 149/1, 88, 89; 89/8

[56] References Cited

U.S. PATENT DOCUMENTS

| | | | |
|---|---|---|---|
| 3,727,407 | 4/1973 | Rains | 149/20 |
| 3,883,377 | 5/1975 | Wright | 149/88 |
| 4,084,480 | 4/1978 | Moscrip | 89/42.03 |
| 4,337,102 | 6/1982 | Oberth et al. | 149/19.3 |
| 4,907,487 | 3/1990 | Tidman et al. | 89/8 |
| 4,938,814 | 7/1990 | Schoyer et al. | 149/22 |
| 4,950,341 | 8/1990 | Schoyer et al. | 149/22 |
| 4,974,487 | 12/1990 | Goldstein et al. | 89/7 |

FOREIGN PATENT DOCUMENTS

| | | |
|---|---|---|
| 0027973 | 5/1981 | European Pat. Off. . |
| 0124398 | 11/1984 | European Pat. Off. . |
| 0208983 | 1/1987 | European Pat. Off. . |
| 0260419 | 3/1988 | European Pat. Off. . |
| 3613259 | 10/1987 | Fed. Rep. of Germany . |
| 3613260 | 10/1987 | Fed. Rep. of Germany . |
| 2087864 | 3/1982 | United Kingdom . |
| 2098195 | 11/1982 | United Kingdom . |

*Primary Examiner*—Peter A. Nelson

*Attorney, Agent, or Firm*—Scully, Scott, Murphy & Presser

[57] ABSTRACT

A propellent medium for a barreled weapon with electrically-supported liquid propulsion, especially for chemical-electrical hybrid drives with regenerative propellent medium injection. Organic compounds of a combination of carbon and hydrogen are contemplated in a ratio with one or more reactive groups which, with a good exothermic reaction of the propellent medium (hydrocarbon), will facilitate the dissociation of molecules or atoms of lower molecular mass. Hereby, a propellent medium component can be formed from charged hydrocarbon ring systems including reactive groups.

12 Claims, No Drawings

PROPELLENT MEDIUM FOR HYBRID WEAPON

BACKGROUND OF THE INVENTION

1. Field of the Invention

The present invention relates to a propellent medium for a barreled weapon with electrically-supported liquid propulsion, especially for chemical-electrical hybrid drives with regenerative propellent medium injection.

As is well known with regard to electro-thermal weapons, an electric arc is ignited through the applying of a voltage to the electrodes of a plasma burner, wherein the electric arc vaporizes material which is introduced between the electrodes; for example, such as polyethylene, and heats the material into a plasma generating high pressures. The acceleration of the projectile is implemented through the pressure of this heated plasma.

The electrical energy for the acceleration of the projectile, in the instance of the electro-thermal projectile drive, is not directly converted into kinetic energy, but first through the indirect path of the energetic intermediate form constituted of thermal energy. A prerequisite for the attainment of a high degree of efficiency during the conversion of the electrical or essentially electromagnetic energy into kinetic energy, consequently, in the first instance is the effective generation of the plasma through thermal energy.

1 2. Discussion of the Prior Art

In the utilization of inert materials; for example, such as polyethylene, for the generating of a highly-charged plasma, these materials must be initially vaporized through the action of the electric arc within the plasma burner, and then thermally split into radicals such that, after the dissociation of the later, there is primarily a presence of carbon and hydrogen. This signifies that a quite appreciable quantity of the utilized electrical energy must be expended for the dissociation of the inert material, as a result of which the degree of efficiency is adversely influenced.

SUMMARY OF THE INVENTION

Accordingly, it is an object of the present invention to provide a propellent medium of the above-mentioned type in which by means of supplemental energy which is available largely independently of the utilized electrical energy, the degree of efficiency is substantially increased through an exothermic, chemical reaction sequence and the demand for electrical energy is significantly lowered.

The foregoing object is inventively achieved in that organic compounds of a combination of carbon and hydrogen are contemplated in a ratio with one or more reactive groups which, with a good exothermic reaction of the propellent medium (hydrocarbon), will facilitate the dissociation of molecules or atoms of lower molecular mass. Hereby, a propellent medium component can be formed from charged hydrocarbon ring systems including reactive groups.

Whereas, for the conversion of polyethylene or the like inert materials, there must be continually supplied electrical energy for their vaporization and dissociation in order to generate a plasma, the employment of reactive liquid propellent media affords the advantage that subsequent to the coupling in of a certain activating energy, because of the exothermic reaction capability of the propellent there can be obtained an additional chemical energy excess.

Thus, largely independently of the utilized electrical energy, there is obtained a supplemental energy through a chemical reaction sequence. Moreover, there can be employed substances which dissociate more readily than inert materials (such as, for instance, polyethylene) and which produce energy already during their dissociating reaction. The further chemical energy recovery is effected due to the chemical reaction of the radicals which are produced during the dissociation of the propellent medium.

Moreover, the reaction products from the propellent medium evidence a significantly lower average molecular mass for the propellent gas or, respectively, the plasma, as a result of which, in comparison with powder-based hybrid weapons, the muzzle velocity can be significantly increased.

When, in addition thereto the gases or, in essence, the reaction products which are produced during the combusting of the propellent medium are further heated through the utilization of the electrical energy, then the individual gases dissociate into lower-molecular or essentially atomic disintegration products. In consequence of the low molecular mass, the number of molecules increases and thereby the pressure for the same volume. Moreover, the sonic velocity is increased due to the lower molecular mass and higher temperature. The temperatures which are encountered in a plasma can be stated as being 10,000 to 20,000° K. When a complete dissociation of the molecules of the propellent gas is assumed, the average molecular mass of the propellent gas generated from propellent powder charges for tank cannons can be reduced from about 20–25g to about 10g. In the utilization of conventional liquid propellent media, the average molecular mass of the propellent gas is about 15–17g in accordance with the mixture of the propellent medium, which through complete dissociation can be reduced to values of below 5–7g. Accordingly, in comparison with a powder-based drive, for an electrically-supported liquid or fluid drive there is obtained a reduction in the molecular mass of between 30–40% depending upon the propellent mixture, and an increase in the velocity of sound of the propellent gases at the same plasma temperature of between 20–30%. These values can be still further increased through the utilization of a propellent mixture which is optimized with regard to its intended purpose of application.

Through the utilization of supplementary electrical energy, there is consequently opened up the possibility of employing liquid propellent media which, because of their somewhat lower specific energy (force of approximately 1,000 J/g), appear to be less suited for the operation of a high-powered weapon with a purely liquid drive. Hereby, on the other hand, these propellent media possess two decisive advantages:

1. The propellent media deliver reaction products with lowered molecular mass, as a result of which there can be increased the muzzle velocity.
2. Due to their high ignition threshold, these propellent media can be counted among the so-called LOVA (Low Vulnerability Ammunition) propellent media; or in essence, "Insensitive Ammunitions".

The selection of the suitable propellent media components is carried out on the basis of the viewpoint that an optimizing of mutually oppositely running effects takes place. Reactive groups lead to chemical conversions with an energy recovery; nevertheless, with the disadvantage of a relative high molecular mass for the reaction products. The dissociation of pure hydrocarbon-molecule chains leads to lower-molecular products with lower molecular mass; however, subject to the disadvantage that these processes take place extensively endothermally. At the combination of carbon-hydrogen radicals with one or more reactive groups there is attained a high specific energy, a high explosion temperature and a low molecular mass for the reaction products at a high covolume and higher specific heat. In accordance with specific features of the invention, different groups can be employed as reactive groups. Moreover, these materials can be mixed among each other, such that the propellent medium is constituted from a mixture of a plurality of such materials. Depending upon need, for purposes of phlegmatizing, the reactive groups may also have relatively inert additives introduced therein; for example, longer-chained hydrocarbons or alcohols.

As the reactive groups, the following are particularly suitable for the propellent media:

1) Nitroalkanes with one or more nitrogen groups in accordance with the chemical formula $H_3C-CnH_{2n}-NO_2$ (Nitroalkane with one Nitrogroup)

or $H_3C-CnH_{2n}-\overset{\overset{NO_2}{|}}{CH}-CnH_{2n}-NO_2$ (Dinitroalkanes or Polynitoralkanes)

2) Alkanoxide with one or more oxide groups according to the chemical formula

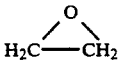

(Ethyleneoxide)

or

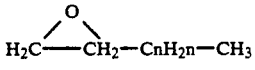

(Polyoxidalkane)

3) Acidic anhydrides according to the chemical formula

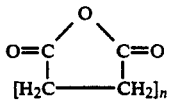

(Anhydride of a Butanedicarbonacid)

4) One or more ethylene groups or acetylenecontaining alkene or alkine according to the chemical formula $R-C\equiv C-R$ (Alkine)

or $R-C\equiv C-R-C\ \ C-R$ (multiple Alkine)

5) Cyclical nitrogen compounds according to the chemical formula

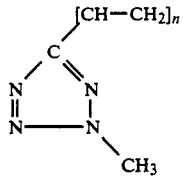

6) Azides according to the chemical formula $R-CH_2N_3$ (Axide)

7) Azo compounds

The special advantages of the new propellent media lie in the properties and in the behavior of the employed materials. In particular, to be mentioned are:

- a reproducible combusting;
- a rapidly running reaction during the conversion; however, which does not take place detonatively;
- a high chemical energy potential at adequate chemical stability;
- present in the form of a liquid within the entire temperature range of −45° C. to +80° C.;
- does not act corrosively;
- to the greatest extent is nontoxic, which signifies that the materials are not particularly hazardous to the health;
- in the admixtures of the different materials among each other no mixture gaps are encountered within the necessary temperature range;
- the components which are to be admixed are mutually compatible;
- low vapor pressure and high flame point;
- low incendiary and explosion danger;
- good storability;
- satisfactory compliance with ordinances relating to the transport of hazardous materials on highways, railroads, by sea and air;
- possessing properties which are the least injurious to the environment, and simple manufacture at low production costs;
- a non-problematic behavior at accidents and when subjected to enemy fire, especially since there is no encountering of any detonative conversion;
- security against spontaneous combustion and self-destruction or detonation under high-dynamic compression of the liquid materials, under adiabotic compression of bubbles entrained in the liquid, under friction and temporary "Hot Spots", under contact with hot surfaces and under cavitation;
- a good ignitability under weapon requirements, and;
- the lowest possible molecular masses for the dissociation and reaction products.

Due to the particular behavior of hydrocarbon structures and reactive groups for each propellent medium which consists of only one specific substance, and through which the chemical composition of the applicable material is set to completely specific values, there are obtained optimized values, especially with regard to propellent mixtures.

An advantageous propellent medium component in connection with proposed types of propellent media, which leads to the highest possible energy yield, in accordance with the features of the invention, consists of charged hydrocarbon ring systems with reactive groups; for example, such as nitro groups or Azo groups.

The liquid propellent medium which is to be employed, pursuant to the invention must contain one or more reactive groups, as well as hydrogen and carbon in such a ratio in that there is resultingly achieved a relatively energy-rich exothermic reaction, and the hereby produced and already partially dissociated reaction products can be easily decomposed or essentially dissociated into molecules of extremely low molecular mass by an application of electrical energy.

There has been shown the existence of suitable materials with the required properties for such a propellent medium. These propellent medium components, besides a hydrocarbon structure generally also possess reactive groups which are particularly adapted for a further electrically-initiated dissociation.

What is claimed is:

1. Propellent medium for a barreled weapon with electrically-supported liquid propulsion, especially for chemical-electrical hybrid drives with injection of a regenerative organic compounds of a combination of carbon and hydrogen including one or more reactive groups at a ratio which facilitates the splitting off of molecules or atoms of lower molecular mass at a good exothermic reaction of the propellant medium (hydrocarbon).

2. A propellent medium as claimed in claim 1, wherein a propellent medium component is formed from charged hydrocarbon ring systems with reactive groups.

3. A propellent medium as claimed in claim 1, wherein said reactive group comprises nitroalkanes with one or more nitro groups,

4. A propellent medium as claimed in claim 1, wherein said reactive group comprises alkane oxide with one or more oxide groups.

5. A propellent medium as claimed in claim 1, wherein said reactive group comprises acidic anhydride, selectively including a butane dicarbonic acid.

6. A propellent medium as claimed in claim 1, wherein said reactive group comprises alkine which contain one or more ethylene groups.

7. A propellent medium as claimed in claim 1, wherein said reactive group comprises cyclical nitrogen compounds.

8. A propellent medium as claimed in claim 1, wherein said reactive group comprises azo compounds.

9. A propellent medium as claimed in claim 1, wherein said reactive group comprises azides.

10. A propellent medium as claimed in claim 1, wherein said reactive group comprises a combination of two or more of the materials as claimed in any one of claims 3 through 9 within a single molecule.

11. A propellent medium as claimed in claim 1, wherein a substantially inert additive is introduced into the material of the reactive groups.

12. A propellent medium as claimed in claim 1, wherein the materials of the reactive groups have longerchained hydrocarbon materials or alcohols introduced therein.

* * * * *

UNITED STATES PATENT AND TRADEMARK OFFICE

CERTIFICATE OF CORRECTION

PATENT NO. : 5,188,682

DATED : February 23, 1993

INVENTOR(S) : Gunther Lockner, et al.

It is certified that error appears in the above-identified patent and that said Letters Patent is hereby corrected as shown below:

Column 1, line 30: delete "1"

Column 5, line 22, Claim 1: after "regenerative" insert --propellent medium; said propellent medium comprising--

Signed and Sealed this

Twenty-third Day of November, 1993

Bruce Lehman

*Attest:*

BRUCE LEHMAN

*Attesting Officer*

*Commissioner of Patents and Trademarks*